US006449916B1

(12) United States Patent
Waters

(10) Patent No.: US 6,449,916 B1
(45) Date of Patent: Sep. 17, 2002

(54) MULTI-GLAZED PANEL AND METHOD OF FABRICATION

(76) Inventor: George E. Waters, 815 W. 18th St., Costa Mesa, CA (US) 92627

( * ) Notice: Subject to any disclaimer, the term of this patent is extended or adjusted under 35 U.S.C. 154(b) by 0 days.

(21) Appl. No.: 09/553,726

(22) Filed: Apr. 20, 2000

(51) Int. Cl.[7] ..... E06B 3/70

(52) U.S. Cl. ..... 52/455; 52/456; 52/311.1; 52/311.2; 52/311.3; 428/13; 428/38; 428/46; 428/60; 428/156; 428/213; 428/432; 156/63; 264/220

(58) Field of Search ..... 52/455, 456, 311.1, 52/311.2, 311.3; 428/13, 38, 46, 60, 156, 213, 432; 156/63; 264/220

(56) References Cited

U.S. PATENT DOCUMENTS

| | | | | |
|---|---|---|---|---|
| 3,872,198 A | | 3/1975 | Britton | |
| 3,998,680 A | | 12/1976 | Flint | |
| 4,216,184 A | | 8/1980 | Thomas | |
| 4,335,170 A | | 6/1982 | Butler | |
| 4,822,680 A | | 4/1989 | Catalano et al. | |
| 4,830,804 A | | 5/1989 | Weaver | |
| 4,834,931 A | | 5/1989 | Weaver | |
| 4,861,540 A | | 8/1989 | Nieboer et al. | |
| 4,925,511 A | | 5/1990 | Ikeda et al. | |
| 4,951,927 A | | 8/1990 | Johnston et al. | |
| 4,996,808 A | | 3/1991 | Weaver | |
| 5,061,531 A | * | 10/1991 | Catalano | 52/790 |
| 5,391,411 A | | 2/1995 | Rowland et al. | |
| 5,558,827 A | * | 9/1996 | Howes | 264/220 |
| 5,599,608 A | | 2/1997 | Yamamoto et al. | |
| 5,655,341 A | | 8/1997 | Jaffiol et al. | |
| 5,783,264 A | | 7/1998 | Howes | |
| 5,783,287 A | | 7/1998 | Yamamoto et al. | |
| 5,840,391 A | | 11/1998 | Eichhorn et al. | |
| 5,846,463 A | | 12/1998 | Keeney et al. | |
| 5,944,862 A | | 8/1999 | Howes | |
| 5,997,793 A | | 12/1999 | Lahnala | |

FOREIGN PATENT DOCUMENTS

| | | |
|---|---|---|
| WO | WO98/30377 | 7/1998 |

* cited by examiner

*Primary Examiner*—Jose V. Chen
*Assistant Examiner*—Chi Q Nguyen
(74) *Attorney, Agent, or Firm*—Gene Scott-Patent Law & Venture Group

(57) ABSTRACT

A method for fabricating a decorative window insert, and from the insert a decorative window, comprises the steps of producing a plurality of planar glass units each adapted by size and shape, for assembly together as a decorative insert master by assembling the planar glass units into a planar assembly wherein the planar glass units are joined by a came, producing a mold from the decorative insert master, the mold replicating the decorative insert master with a came mold portion and a planar glass units mold portion, filling the came mold portion of the mold with a dyed catalyzed resin and curing the resin as a simulated came portion of the insert, filling a planar glass units mold portion of the mold with a non-dyed catalyzed resin and curing it as a simulated glass portion of the insert followed by a post-curing of the simulated came portion and the simulated glass portion to produce the decorative window insert.

3 Claims, 4 Drawing Sheets

MULTI-GLAZED PANEL AND METHOD OF FABRICATION

The present application claims priority of a previously filed provisional patent application having Ser. No. 60/129,954 and an assigned filing date of Apr. 20, 1999, and which contains subject matter substantially the same as that described and claimed in the present application.

The present application describes technical matter of a previously filed disclosure filed with the United States Patent And Trademark Office disclosure program on Apr. 20, 1998 as Ser. No. 436835 and which contains subject matter substantially the same as that described and claimed in the present application.

BACKGROUND OF THE INVENTION

1. Field of the Invention

This invention relates generally to transparent decorative window glazing constructions and more particularly to a method of making a decorative window glazing and a product of such method.

2. Description of Related Art

The following art defines the present state of this field:

Howes, et. al. U.S. Pat. No. 5,558,827 A simulated multipane window consists of a thick transparent plastic resin layer molded onto a sheet of glass. The outer surface of the resin layer includes a simulated came structure between adjacent panel portions of the window. The decorative window is produced as a replica of a glass master, originally made using actual glass panels such as beveled glass panels. The master is then covered with a mixture of silicone, catalysts for curing the silicone, and a light oil to form a mold. After curing, the mold is removed from the glass master, inverted, and a glass sheet, which has been prepared for the process by being coated with organosilane ester, is clamped thereto. The mold cavity is then filled with a mixture of a clear plastic resin, catalysts for curing the resin, and organosilane ester. After curing, the simulated multipane window is removed from the mold.

Howes, et. al. U.S. Pat. No. 5,783,264 describes a decorative window consisting of a thick transparent plastic resin layer laminated to a sheet of glass The outer surface of resin layer includes decorative features, such as deeply contoured pictographic images and finely detailed textured surfaces. The decorative window is produced as a replica of a glass master originally made using conventional grinding and surface finishing techniques. The master is then covered with a mixture of silicone, catalysts for curing the silicone, and a light oil to form a mold. After curing, the mold is removed from the glass master, inverted, and a glass sheet, which has been prepared for the process by being coated with organosilane ester, is clamped thereto. The mold cavity is then filled with a mixture of a clear plastic resin, catalysts for curing the resin, and organosilane ester. After curing, the replicated decorative window is removed from the mold.

Howes, et. al. U.S. Pat. No. 5,944,862 describes a decorative window consisting of a thick transparent plastic resin layer laminated to a sheet of glass. The outer surface of resin layer includes decorative features, such as deeply contoured pictographic images and finely detailed textured surfaces.

The decorative window is produced as replica of a glass master originally made using conventional grinding and surfaces finishing techniques. The master is then covered with a mixture of silicone, catalysts for curing the silicone, and a light oil to form a mold. After curing, the mold is removed from the glass master, inverted, and a glass sheet, which has been prepared for the process by being coated with organosilane ester, is clamped thereto. The mold cavity is then filled with a mixture of a clear plastic resin, catalysts for curing the resin, and organosilane ester. After curing, the replicated decorative window is removed from the mold.

Catalano, et. al. U.S. Pat. No. 5,061,531 describes an insulating architectural glass unit for residential, nonresidential and commercial applications having at least two panes of glass plate separated by an encapsulated air space, constructed with an injection molded frame of relatively low thermal conductivity material, wherein a secondary seal between the individual glass plates and a frame structure surrounding the glass plates are molded as a single piece continuous structure in a single step operation.

Eichhom, et al. U.S. Pat. No. 5,840,391 describes a decorative glass sheet simulating a multi-pane, camed window or door, and a method for forming the same. The decorative glass sheet includes a glass panel having an outer surface. At least one groove is formed through the outer surface and into the glass panel. Each groove includes a first wall extending from a first peripheral edge to a groove bottom apex, and a second wall extending from the apex to a second peripheral edge. The second wall has a width greater than a width of the first wall. At least one decorative caming strip is adhered to the outer surface of the glass panel and is disposed adjacent and along the first peripheral edge of the at least one groove.

Catalano, et al. U.S. Pat. No. 4,822,680 describes a polyurethane-filmed glass material for use as monolithic insulated glass or laminated glass in spandrel application. A polyurethane sheet, which has been ultraviolet light-stabilized, is pigmented, coated or otherwise colored to produce a coloring that is predictable and reproducible. A coupling agent is employed and the polyurethane adheres directly to a glass sheet without glues or adhesives. The manufacture of the glass material includes laying a sheet of colored polyurethane sheet material on a sheet of glass, which has been prepared with a coupling agent. Outside surfaces of the polyurethane are coated with a release material. The glass sheet and the prepared polyurethane sheet are then loaded into a vacuum bag, which in turn is then loaded into an autoclave. The bag is subjected to a vacuum while the autoclave vessel is pressurized. The autoclave vessel is simultaneously run through a temperature curve to heat and cool the polyurethane and glass whereby the polyurethane is temporarily softened and thereby adheres to the glass. The laminated product is thereafter tempered.

Butler, et. al. U.S. Pat. No. 4,335,170 describes a method of simulating stained and leaded glass windows, including bonding lead strips to a pane of glass or plastic to form design segments, and bonding coatings to the pane coincidental with the design segments to simulate colored glass, and the simulated stained and leaded glass structure produced by the method.

Flint, et. al. U.S. Pat. No. 3,998,680 describes a method of fabricating insulating glass units with a hot-melt butyl rubber sealant composition.

Weaver, et. al. U.S. Pat. No. 4,830,804 describes an insert which forms the show or finish surface (the surface exposed to the weather) for an elastomeric gasket in an encapsulated window assembly. The insert is thermoformed from a sheet of plastic and placed in the lower half of a mold. A sheet of glazing material is also placed in the lower mold half, and an upper mold half is utilized to close the mold cavity. Gasket forming material is injected into the mold cavity to form a gasket in situ that adheres to both the peripheral marginal areas of the transparent sheet and the insert. The insert can be formed with a gate portion that extends into the gate area of the mold and prevents the gasket forming material from flowing onto the surface of the insert that is to be exposed in the final glazing. In one embodiment, the insert can be formed in its final configuration with a central opening leaving the transparent sheet exposed. In an alternate embodiment, the insert is formed with a centrally disposed portion that covers the transparent sheet material to protect it. A groove can be formed in the insert to facilitate removal of the central portion.

Thomas, et. al. U.S. Pat. No. 4,216,184 describes a method of injection-molding articles of plastics material onto a preformed web inserted into the mould, the web held under substantially constant tension during the closing of the mould, between a pair of clamps, the proximal clamp being fixed relative to the mould and the distal clamp free but bearing a load to furnish the desired tension in the web. The load may be imposed by a weight attached to the distal clamp, conveniently by means of an electromagnet.

Lahnala, et. al. U.S. Pat. No. 5,997,793 describes a process for forming an encapsulated window assembly, including a gasket member surrounding a peripheral region of a transparent sheet, and a peripheral seal secured to the gasket member. The peripheral region of the transparent sheet, as well as a preformed periphery seal assembly, are positioned within a mold cavity. The periphery seal assembly includes an elastomeric seal secured to a seal support member, with the seal support member being relatively rigid as compared with the elastomeric seal. The mold is closed, bring the mold sections into facing relationship, whereby opposed surfaces of the seal support member of the periphery seal assembly are engaged between a surface of the first mold section and a surface of the second mold section. A molding material is injected into the mold so as to fill the mold cavity, then allowed to solidify, and the mold is opened and the encapsulated window assembly is removed. The invention also relates to the resulting encapsulated glazing unit and mold apparatus.

Ikeda, et al. U.S. Pat. No. 4,925,511 describes a method of fitting a plate member with at least one supportive or protective member of a synthetic resin by injection molding of the resin with insertion of, for each resin member, a predetermined marginal region of the plate member in the mold cavity. A vehicle window glass is fitted with two holders to be coupled with a window regulator mechanism. To enhance strength of adhesion of the molded resin member (s) to the plate without making any mechanical or thermal treatment of the plate, the marginal region of the plate is closely covered with at least one sheet of plastic film, which has a thickness of 5 to 250 microns and becomes a melt adhesive to both the plate and the molded resin at a temperature in the range from 50 degree to 150 degree C., prior to insertion of the marginal region of the plate into the mold cavity. The plastic film is of an ethylene base copolymer.

Weaver, et. al. U.S. Pat. No. 4,834,931 describes a window assembly including a transparent glass sheet and gaskets formed by curing a polymeric gasket material in situ on the glass sheet to encapsulate a marginal peripheral edge portion thereof. A glass sheet to be utilized in a vehicle door has a front edge, rear edge and a lower edge, to each of which is adhered such a gasket. In addition, a bracket means for attachment to a scissor linkage for raising and lowering the window can be secured to the lower edge of the window. The gaskets are formed in a mold with the transparent sheet and bracket means, typically by a reaction injection molding process. Each of the front and rear gaskets may have a flange portion thereon for insertion in an opening in a gasket attached to a frame of the window opening in the vehicle door.

Jaffiol, et al. U.S. Pat. No. 5,655,341 describes a plastic material injected in the fluid state into a flexible closed mold comprising a molding cavity in which is placed the edge of the glass pane. The plastic material is injected into the cavity of the mold in the inert state and is then activated by high-frequency electromagnetic radiation or by microwave radiation. An insert is placed in the cavity of the mold before the injection of the plastic material. The injection and the subsequent hardening of the plastic material are carried out inside the cavity of the mold [sic] in which cavities are arranged, during these operations, the edge of the glass pane, and the insert in their definitive relative position on the glass pane in the shaped state. The invention can be used to produce glass panes for motor vehicles, comprising inserts consisting of trim strips, for a decorative purpose, or of elements such as ducts, cables or fastening screws having a functional purpose.

Rowland, et al. U.S. Pat. No. 5,391,411 describes a glass laminate assembly comprising two glass sheets with an interlayer of cured resin formed by a cast-in-place process. An aperture for an attachment device is formed in at least one of the glass sheets and a resilient adhesive sealing tape is formed between the faces of the glass sheets and surrounding the hole.

Weaver, et. al. U.S. Pat. No. 4,996,808 describes an insert which forms the show or finish surface (this surface exposed to the weather) for an elastomeric gasket in an encapsulated window assembly thermo-formed from a sheet of plastic and placed in the lower half of a mold. A sheet of glazing material is also placed in the lower mold half and an upper mold half is utilized to close the mold cavity. Gasket forming material is injected into the mold cavity to form a gasket in situ that adheres to both the peripheral marginal areas of the transparent sheet and the insert. The insert can be formed with a gate portion that extends into the gate area of the mold and prevents the gasket forming material from flowing onto the surface of the insert that is to be exposed in the final glazing. In one embodiment, the insert can be formed in its final configuration with a central opening, leaving the transparent sheet exposed. In an alternate embodiment, the insert is formed with a centrally disposed portion that covers the transparent sheet material to protect it. A groove can be formed in the insert to facilitate removal of the central portion.

Keeney, et al. U.S. Pat. No. 5,846,463 describes a window module having a fixed-pane window which is encapsulated by a molded trim piece having an integral portion which extends around an adjacent movable window opening. The integral trim is formed of EPDM. The window module is constructed by placing a window pane, a division post and the end of an extruded EPDM trim strip into a mold into which EPDM is injected to integrate and encapsulate the inserts.

Nieboer, et al. U.S. Pat. No. 4,861,540 describes a method for molding a gasket or casing around a peripheral portion of sheet material with portions of a separate part embedded within the gasket and other portions extending out of the gasket. Preferably, the method is used to form vehicular window assemblies and includes inserting a separate part in a pocket or recess in one of two cooperating mold sections prior to closing the mold, closing the mold such that a portion of the separate part is urged tightly against a part of the recess by the sheet material in the mold, and filling the mold cavity to embed part of the separate part in the gasket while another portion extends out of the cavity.

Yamamoto, et al. U.S. Pat. No. 5,783,287 describes a method for molding a plastic part comprising preforming a film laminate and insert molding a plastic substrate against the film laminate. According to one embodiment, the film laminate is preformed with re-entrant edge portions. The insert molding step involves positioning the film laminate in a mold cavity, closing the mold and injecting molten resin into the mold cavity against the film laminate. The force of the closing of the mold and the injection of the resin causes the re-entrant edge portions to curl up under the solidifying resin to ensure complete coverage of the longitudinal edges of the plastic substrate by the film laminate. According to another embodiment, a stencil of an image is made in the film laminate prior to the insert molding. The resin injected into the mold flows into the stencil so that the image is visible against the surrounding surface of the film laminate.

Yamamoto, et al. U.S. Pat. No. 5,599,608 describes a method for molding a plastic part comprising reforming a film laminate and insert molding a plastic substrate against the film laminate. according to one embodiment, the film laminate is preformed with re-entrant edge portions. The insert molding step involves positioning the film laminate in a mold cavity, closing the mold and injecting molten resin into the mold cavity against the film laminate. The force of the closing of the mold and the injection of the resin causes the re-entrant edge portions to curl up under the solidifying resin to ensure complete coverage of the longitudinal edges of the plastic substrate by the film laminate. According to another embodiment, a stencil of an image is made in the film laminate prior to the insert molding. The resin injected into the mold flows into the stencil so that the image is visible against the surrounding surface of the film laminate.

Johnston, et al. U.S. Pat. No. 4,951,927 describes an encapsulated multiple glazed structure formed by positioning at least two spaced apart substantially coextensive sheets of glazing material wherein the sheets are maintained in aligned spaced relation by a suitable spacer element adjacent to the peripheral portions of the facing surfaces of the glazing sheets. The above assemblage is then typically placed within a mold cavity of a suitable molding apparatus and a charge of an elastomeric gasket forming material is injected therein to form an encapsulating gasket around the peripheral edge portions of the assemblage to produce a multiple glazed structure.

Britton, et. al. U.S. Pat. No. 3,872,198 describes a glazing insert for a door or a window frame, formed of a substantially rigid foam plastics material, such as polyethylene, polypropylene, P.V.C. or urea formaldehyde. The insert may be formed by molding, extrusion, or machining operations or may be formed in situ in a channel in the door or window frame by injection of the foam plastics material into the channel. A single, double, treble, or multiple-glazed unit may be formed by positioning an insert in a frame and inserting one or more sheets of glazing material into corresponding grooves in the insert. Alternatively, the unit may be formed by supporting at least one sheet of glazing material in a channel in a frame and injecting the foam plastics material into the channel.

Lahnala, et. al. WO 98/30377 describes a process for forming an encapsulated window assembly comprising a gasket member surrounding a peripheral region of a transparent sheet and a periphery seal assembly secured to the gasket member. The peripheral region of the transparent sheet, as well as a preformed periphery seal assembly, are positioned within a mold cavity. The periphery seal assembly includes an elastomeric seal secured to a seal support member, with the seal support member being relatively rigid as compared with the elastomeric seal. The mold is closed, bringing the mold sections into facing relationship, whereby opposed surfaces of the seal support member of the periphery seal assembly are engaged between a surface of the lower mold section and a surface of the upper mold section. A molding material is injected into the mold so as to fill the mold cavity, is allowed to solidify, and the mold is opened and the encapsulated window assembly is removed. The invention also relates to the resulting encapsulated glazing unit and mold apparatus.

The prior art teaches methods and products of such methods for producing decorative windows, and especially for simulation of hand crafted window glazing constructions. However, the prior art does not teach a method of producing a triple glazed window construction with sandwiched decorative resin insert where the insert is separately produced and then assembled between outer glazing panels. Further, the prior art does not teach the present method of producing a decorative resin insert for such application. The present invention fulfills these needs and provides further related advantages as described in the following summary.

SUMMARY OF THE INVENTION

The present invention teaches certain benefits in construction and use which give rise to the objectives described below.

The present invention is a method and product thereby for fabricating a decorative window insert, and from the insert a decorative window, and comprises the steps of producing a plurality of planar glass units each adapted by size and shape, for assembly together as a decorative insert master planar assembly joined by a came, producing a mold from the decorative insert master, the mold replicating the decorative insert master with a came mold portion and a planar glass units mold portion, filling the came mold portion of the mold with a dyed catalyzed resin and curing the resin as a simulated came portion of the insert, filling a planar glass units mold portion of the mold with a non-dyed catalyzed resin and curing it as a simulated glass portion of the insert followed by a post-curing of the simulated came portion and the simulated glass portion to produce the decorative window insert.

A primary objective of the present invention is to provide a method for producing a decorative resin window insert and a window assembly using such an insert, the method and the assembly having advantages not taught by the prior art.

A further objective of the present invention is to produce an exact replica of a hand made master decorative window as an insert for a multi-glazed window construction.

Another objective is to provide such a method having very low cost of construction.

A further objective is to provide such a method that is relatively simple and may be applied to a relatively higher production rate.

A still further objective is to provide such a method that results in a product having a high quality hand made appearance.

A yet further objective is to provide such a method resulting in a decorative thermally insulated window.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
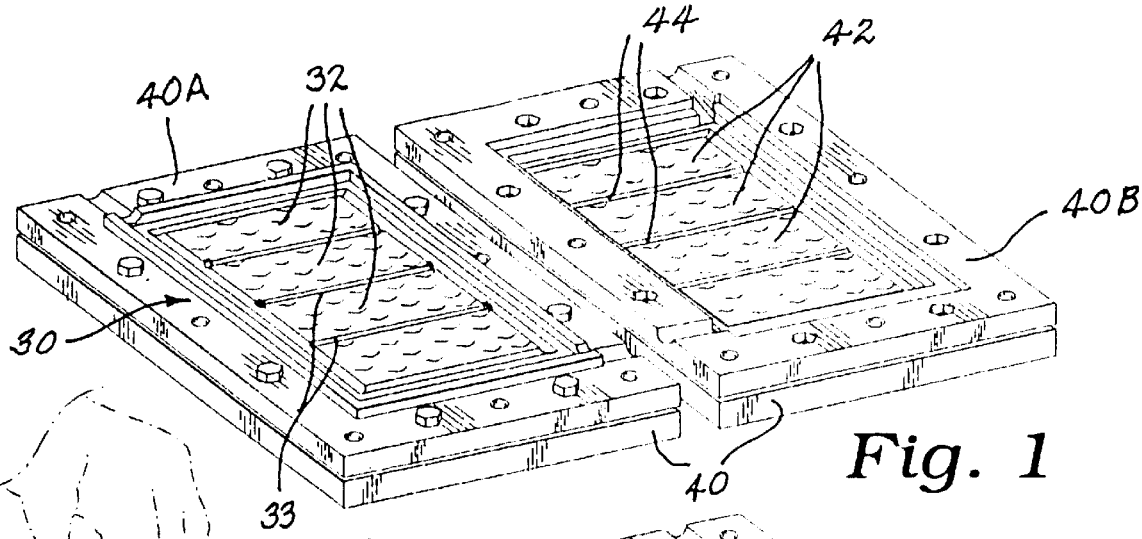
FIG. 1 is perspective view of the preferred embodiment of the present invention showing a two a mold in an open and laid flat orientation.

The above described drawing figures illustrate the invention, a method for producing a decorative window insert 10 for use in a decorative window assembly 20. In summary, the method comprises the steps of producing a plurality of planar glass units 32, said glass units, each adapted by size and shape, for assembly together as a decorative insert master 30, assembling the planar glass units 32 into a planar assembly wherein the planar glass units 32 are joined by a came 33, resulting in the decorative insert master 30 (see FIG. 1), producing a mold 40 from the decorative insert master 30, the mold 40 replicating the decorative insert master 30 with a planar glass units mold portion 42 and a came mold portion 44 (see FIGS. 1 and 2), filling the came mold portion 44 of the mold 40 with a dyed catalyzed resin 54 and curing said dyed catalyzed resin 54 as a simulated came portion 14 of the decorative window insert 10 (see FIG. 8), filling the planar glass units mold portion 42 of the mold 40 with a non-dyed catalyzed resin 52 and curing said non-dyed catalyzed resin 52 as a simulated glass portion 12 of the decorative window insert 10 (see FIGS. 5 and 6), and post-curing the simulated glass portion 12 and the simulated came portion 14 to produce the finished decorative window insert 10 (see FIG. 8).

The mold 40 is made in two halves 40A and 40B. First, the insert master 30 is placed on a mold support surface. Next, a mold barrier is formed around the insert master 30 allowing a clear space of about one inch all around the master 30 on all sides. The mold barrier is higher than the master 30. Mold locks are placed to facilitate later mold alignment. The upfacing surfaces of the insert master 30 are coated with a mold release agent to facilitate release of the mold 40 after it is cured. A mold material, such as an RTV rubber is now poured onto the surfaces of the insert master 30 to the top of the mold barrier and cured. After cure, the mold barrier is removed leaving the first half 40A of the mold 40 completed with the insert master 30 imbedded in it.

Preparation of the second half 40B of the mold 40 is completed in a similar manner after inverting the first half 40A so that the insert master 30 is facing upwardly. The mold barrier is prepared again with its upper edge higher than the came 33 of the insert master 30. The release agent is applied as before. The second half 40B of the mold 40 is poured as described above. After curing, the two halves 40A and 40B of the mold 40 are separated and the insert master 30 is removed. If the mold 40 is made using RTV rubber, it is post cured at this time in accordance with published specifications of the Dow Corning company which are readily available and well known in the art.

Figure 2:
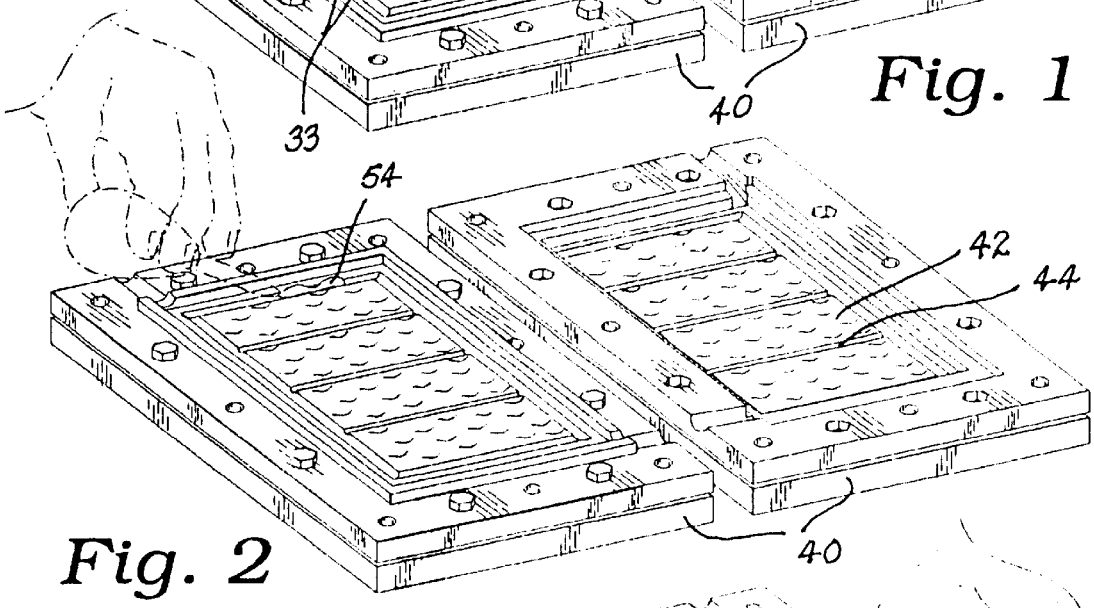
FIG. 2 and 3 are similar to FIG. 1 showing insertion of a came resin into the mold.
Figure 3:
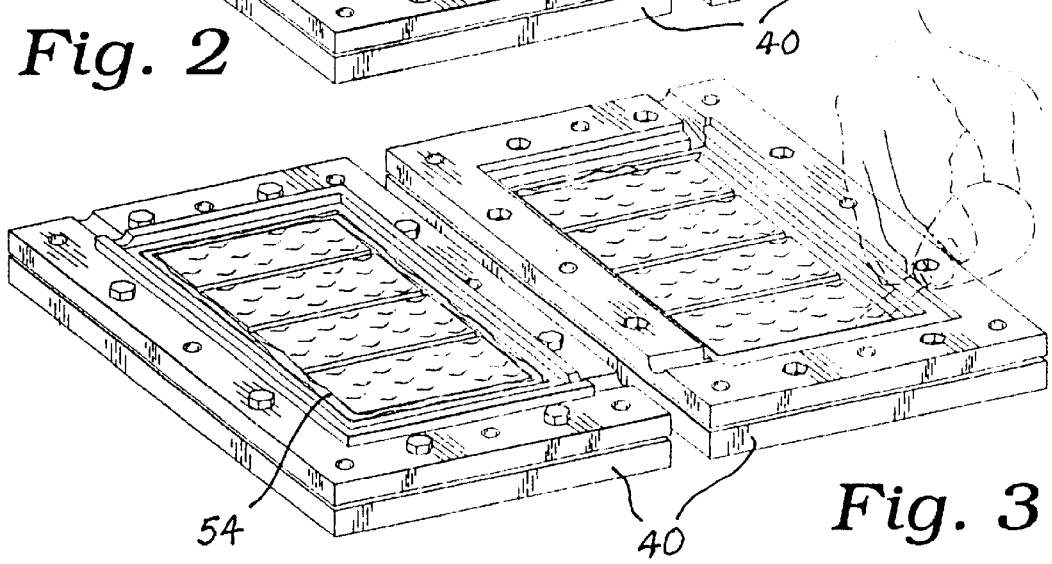
Figure 4:
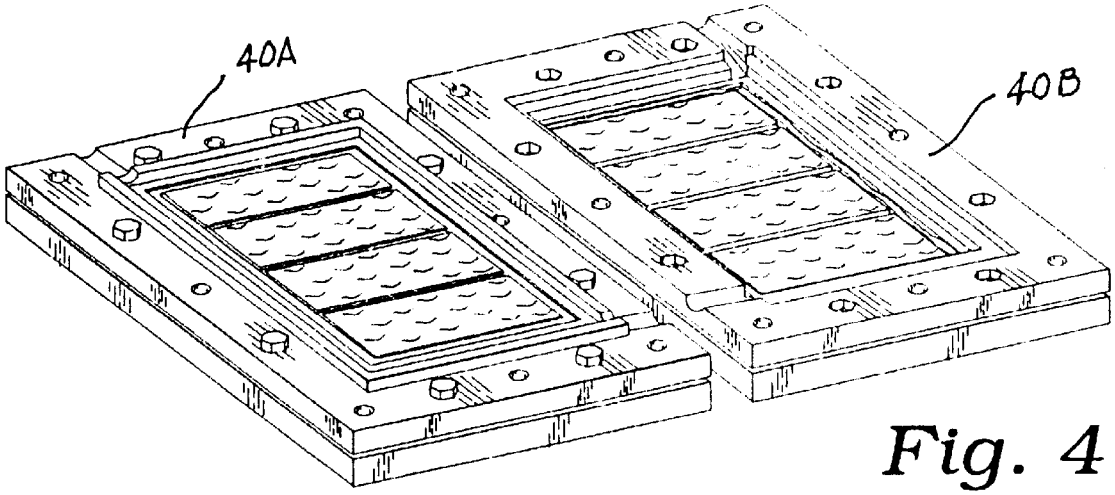
FIG. 4 is similar to FIG. 1 depicting a curing step of the invention method.

The two halves 40A and 40B of the mold 40 are laid out on a flat surface with the came mold portion 44 and the simulated glass mold portion 42 facing upwardly as shown in FIGS. 2 and 3. A resin such as S249A is mixed with a dye or pigment of a desired color to prepare the dyed catalyzed resin 54 and this resin 54 is placed into came mold portion 44 of mold 40 in both mold halves 40A and 40B. The resin 54 is cured, preferably at ambient temperature, to produce the finished simulated came portion 14 of the decorative window insert 10.

Figure 5:
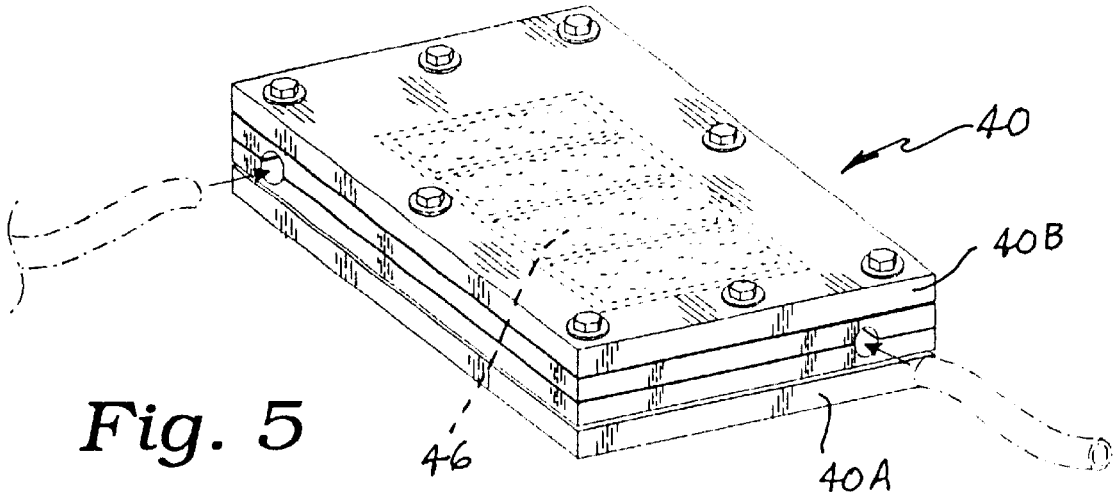
FIG. 5 and 6 show the mold in a closed orientation wherein inlet and outlet tubes are attached to the mold and resin is injected into the mold.
Figure 6:
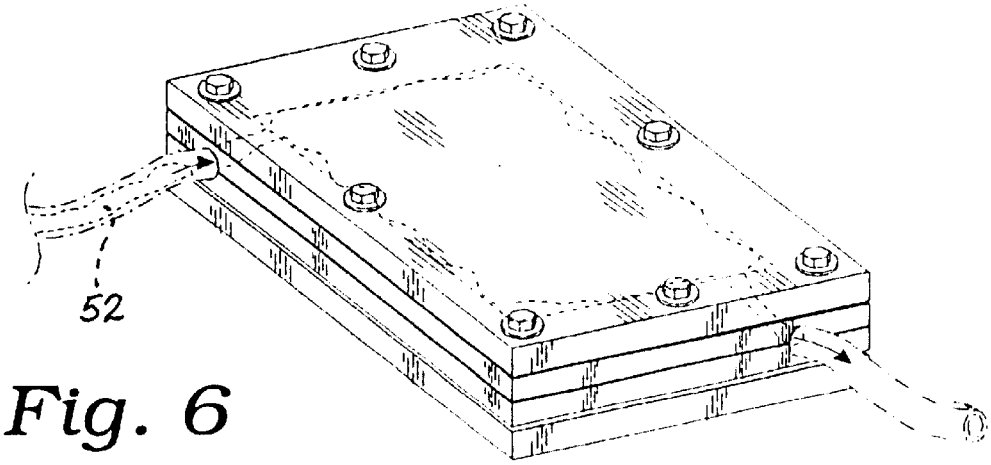
Figure 7:
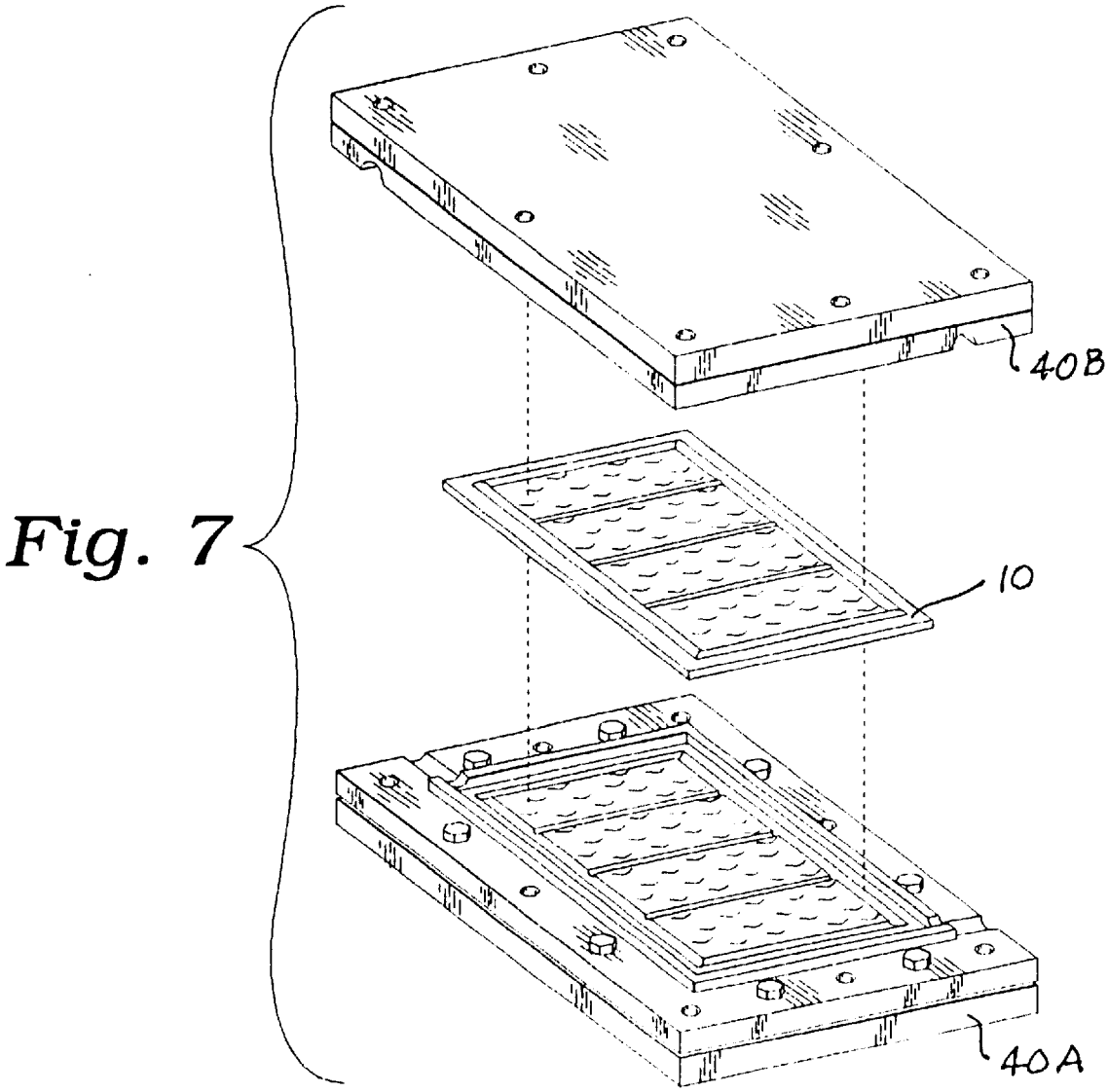
FIG. 7 shows the mold being separated from the insert product of the invention.

The two halves 40A and 40B of mold 40 are now clamped together, as shown in FIGS. 5 and 6, with the came mold portion 44 and the simulated glass mold portion 42 facing inwardly and defining a mold cavity 46. The mold cavity 46 is now filled with resin 52, again, preferably S249A with, or without a tinting agent. After curing, the mold halves 40A and 40B are separated and the finished window insert 10 is removed, as shown in FIG. 7, and placed on a flat surface for post curing. Means for aligning the mold halves 40A and 40B, for insertion of the resin 52 into the cavity 46 and for producing a homogeneous and air bubble free resin material, as well as other incidental features of the molding know-how, are so well known in the art that such need not be described here.

Figure 8:
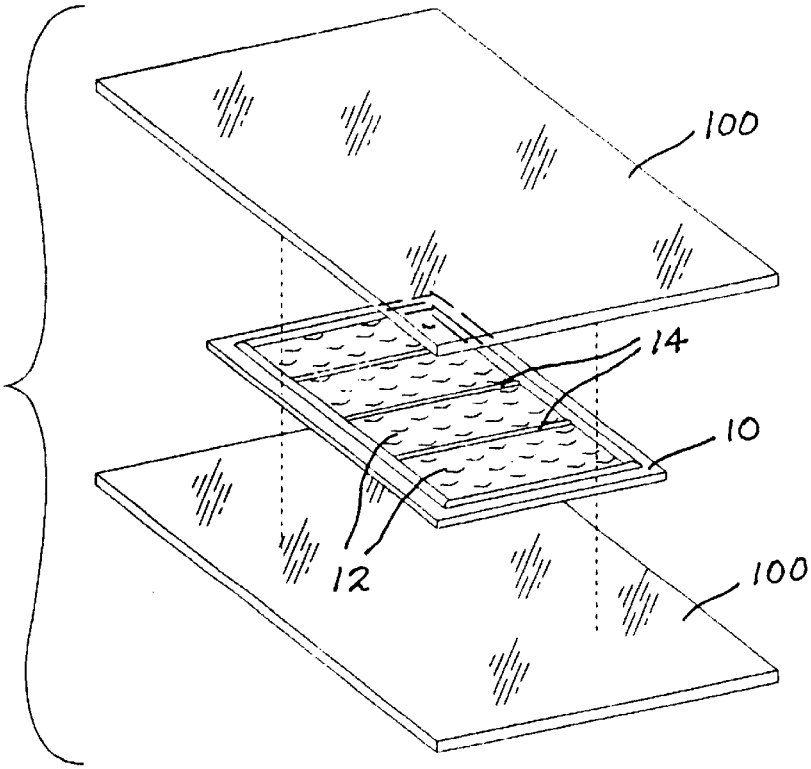
FIG. 8 show the insert being sandwiched between two glass panes.
Figure 10:
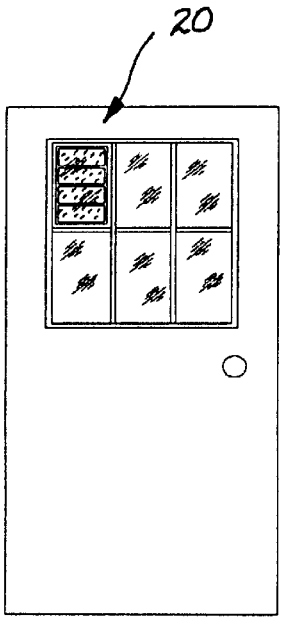
FIG. 10 shows the window as assembled into a door.
Figure 9:
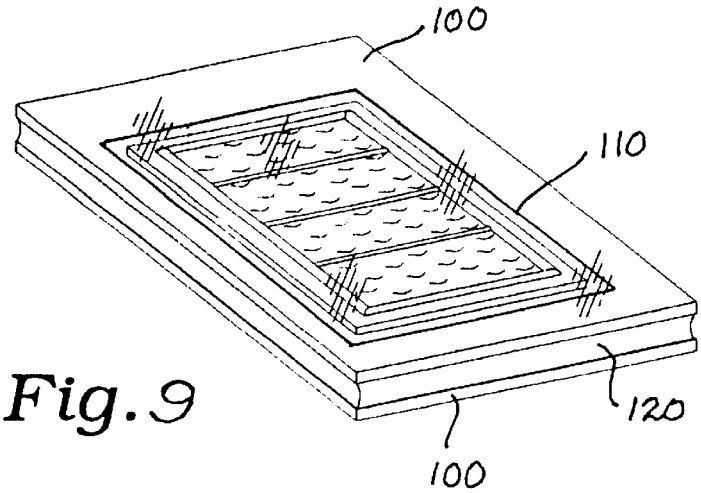
FIG. 9 shows the insert and panes as assembled into a window.

The insert 10 that as produced in this method is not a structural element. The insert 10 is advantageously placed between two sheets of transparent tempered glass 100 in a sandwich arrangement as shown in FIGS. 8 and 9. Preferably, a grooved rubber spacer 110 is placed peripherally on the edge of the insert 10 and may be advantageously bonded into place for holding the tempered glass sheets 100, as shown in FIG. 9. Preferably, the spacer 110 is sealed exteriorly by a secondary sealing material 120 which is cured prior to placing the finished assembly into a door or window frame, as shown in FIG. 10.

Materials used in the above method include mold 40 material- RTV rubber comprising Sylastic M™ and catalyst available from Dow Corning of Lansing, Michigan; resin S249A and its catalyst for decorative insert 10, available from Revchem Plastics, Inc., Bloomington, Calif.; Carnuba Wax™ petroleum jelly release agent; and grooved rubber spacer 110 and secondary sealing material 120 from Sommer-Macca, Los Angeles, Calif.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method for making a decorative window insert comprising the steps of:

placing a dyed catalyzed resin in a first part of a simulated came portion of a two part mold;

placing a non-dyed catalyzed resin in a simulated glass units portion of the two part mold;

curing the non-dyed and dyed catalyzed resins as a decorative window thereby having simulated came on an obverse surfaces thereof;

inverting the two part mold;

placing further of the dyed catalyzed resin in a second part of the simulated came portion of the two part mold;

curing the further dyed catalyzed resin, the decorative window thereby having simulated came on a reverse surface thereof;

whereby the came portions and the glass units portion are cured as an integral free-standing resin part.

2. The method for making a decorative window insert of claim 1 further including the step of extending the came portion of the insert outwardly from at least one of the obverse and reverse surfaces.

3. The method for making a decorative window insert of claim 1 further including the step of sandwiching the insert between a pair of transparent glass sheets and supporting the glass sheets by a window frame.

* * * * *